US008316508B2

(12) United States Patent
Lapping

(10) Patent No.: US 8,316,508 B2
(45) Date of Patent: Nov. 27, 2012

(54) REMOVABLE TRACK SYSTEM AND METHOD FOR TENT SIDEWALLS

(75) Inventor: Hal P. Lapping, Miami, FL (US)

(73) Assignee: Economy Tent International, Inc., Miami, FL (US)

( * ) Notice: Subject to any disclaimer, the term of this patent is extended or adjusted under 35 U.S.C. 154(b) by 2 days.

(21) Appl. No.: 13/100,352

(22) Filed: May 4, 2011

(65) Prior Publication Data

US 2012/0198655 A1 Aug. 9, 2012

Related U.S. Application Data

(60) Provisional application No. 61/439,160, filed on Feb. 3, 2011.

(51) Int. Cl.
*E05D 15/00* (2006.01)

(52) U.S. Cl. ..... 16/87.6 R; 16/87.2; 135/121; 160/350

(58) Field of Classification Search ..... 16/90, 91, 16/94 R, 94 D, 87 B, 87.2, 87 R, 87.4 R, 16/87.6 R, 87.8; 135/121, 115, 117, 119, 135/120.3, 144, 16, 98; 160/350, 330, 333
See application file for complete search history.

(56) References Cited

U.S. PATENT DOCUMENTS 3,361,190 A * 1/1968 Snyder ..... 160/330
3,484,892 A * 12/1969 Hachtel ..... 16/87.2
3,596,306 A * 8/1971 Wachenheimer ..... 16/87.2
3,616,486 A * 11/1971 Ford et al. ..... 16/87.2
3,795,380 A * 3/1974 Turner ..... 248/263
3,815,656 A * 6/1974 Kober et al. ..... 160/123
3,881,217 A * 5/1975 Bytheway, Jr. ..... 16/87.2
4,125,143 A * 11/1978 Pape et al. ..... 160/348
4,485,523 A * 12/1984 Higgins ..... 362/490
7,174,944 B1 * 2/2007 Clark et al. ..... 160/197
7,788,769 B2 * 9/2010 Wicker et al. ..... 16/87 R
2006/0042673 A1 * 3/2006 Tseng ..... 135/117
2007/0289090 A1 * 12/2007 Cai ..... 16/87.2

OTHER PUBLICATIONS

Warner Shelter Systems Limited movable tent walls on instructional manuals for tent assembly by Peak Marquee Tent in Canadaat www.wssl.com/pdfs/mq20th-manual.pdf (2 pgs.); see also Model MQ20H Assembly Instructions Jul. 28, 2010 (12 pgs.).

* cited by examiner

*Primary Examiner* — Chuck Y. Mah
(74) *Attorney, Agent, or Firm* — Robert C. Kain, Jr.

(57) ABSTRACT

The removable track and hanger system is mounted on horizontal tent frame members. The tent frame includes horizontal and vertical frames for supporting the overlaid tent fabric. The track and hanger system includes a track bar removably hung from a horizontal frame member by a complementary shaped inverted J-shaped hangers. The track bar includes a track bar channel, an open mouth and an interior cavity. A eyelet hangers protrude from the track bar because a capture element (roller wheel, ball or glide element) is located in the cavity and a downward eyelet extender has an eyelet hole into which is clipped a clip hook from the tent sidewall. When clipped onto the hanger track, the tent sidewall can move horizontally along the track. The throw or horizontal movement of the tent sidewall is limited by stops at one or more predetermined stop locations.

11 Claims, 5 Drawing Sheets

REMOVABLE TRACK SYSTEM AND METHOD FOR TENT SIDEWALLS

This is a regular patent application based upon and claiming the benefit of priority of provisional patent application Ser. No. 61/439,160 filed Feb. 3, 2011.

The present invention relates to a removable track and hanger system which is removably mounted on a horizontal frame of a tent frame system wherein tent sidewalls are attached to rack and hanger elements permitting the sidewall to be moved horizontally with respect to the horizontal frame member.

BACKGROUND OF THE INVENTION

Large event tents typically are assembled and disassembled utilizing a series of horizontal tent frame members and vertical tent frame poles which are joined together by specially configured joints. The tent roof is elevated above the horizontal tent frame members by roof supports or trusses which are coupled to the tent frame system. The tent fabric or material is draped on the tent frame members. Also, stationary tent sidewalls are sometimes used to cover the side openings of the tent to exclude rain and wind and sometimes to retain heat and light inside the tent. However, it is sometimes desirable to have sidewalls which can be moved back and forth (longitudinally along the horizontal frame) to provide an entrance and/or an exit from the interior of the tent.

Movable prior art tent sidewalls are typically attached to a rope that has been horizontally strung between either the vertical tent frame poles or hung from the horizontal tent frame member. The prior art system includes tent sidewalls having a plurality of clip hooks attached to the top edge of the sidewalls. The clip hooks clip onto the rope which is strung horizontally between the vertical poles or on the horizontal frame. Since the clip hooks have an open clip region, the attached tent sidewalls can be moved longitudinally along the rope to establish an entrance or an exit for the tent.

OBJECTS OF THE INVENTION

It is an object of the present invention to provide a removable track and hanger system which can be easily mounted on horizontal tent frame members and removed from the horizontal members permitting the track to be stored with the tent frame elements and vertical poles.

It is a further object of the present invention to provide a removable track and hanger system which utilizes the existing clip hooks and tent sidewalls.

It is a further object of the present invention to provide a track and hanger system whereby the movement of tent sidewalls is limited by removable stops.

It is another object of the present invention to mount the removable track system on any horizontal frame of the tent frame.

SUMMARY OF THE INVENTION

The removable track and hanger system is mounted on a horizontal tent frame member. These tent frame members, in combination with vertical tent frame poles, form a framing structure on which is placed the tent fabric cover or material. The removable track and hanger system includes a track bar which is removably hung from the horizontal frame member by a plurality of inverted J-shaped hangers. These hangers have a downwardly extending legs which are coupled to the track bar. The track bar includes a track bar channel defined by an open mouth and an interior cavity. The cavity is larger than the channel mouth. A plurality of eyelet hangers protrude from the track bar channel. The eyelet hangers are movably mounted in the channel. Each eyelet hanger has an upper body with a capture element located within the track bar cavity and a downward extender which defines an eyelet hole. A respective clip hook from the tent sidewall is clipped into the eyelet hole and, when a number of clips are attached to the movable eyelets, the tent sidewall can move horizontally along the track bar. The method includes providing a track bar with a plurality of downwardly protruding eyelet hangers which are movably mounted within the track bar. The track bar is hung at a plurality of locations on the horizontal tent frame. The track bar can be removed and reinstalled on the frame. The eyelet hangers are permitted to roll within the track bar or are permitted to glide under low friction conditions within the track bar. The tent sidewall clip hooks are clipped onto the downwardly protruding eyelet hangers such that the tent sidewall can be removed and reinstalled on the track bar. The throw or horizontal movement of the tent sidewall is limited by stops at one or more predetermined stop locations.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a removable track and hanger system tent sidewalls and a method for the same. Similar numerals designate similar items throughout the drawings.

Figure 1A:
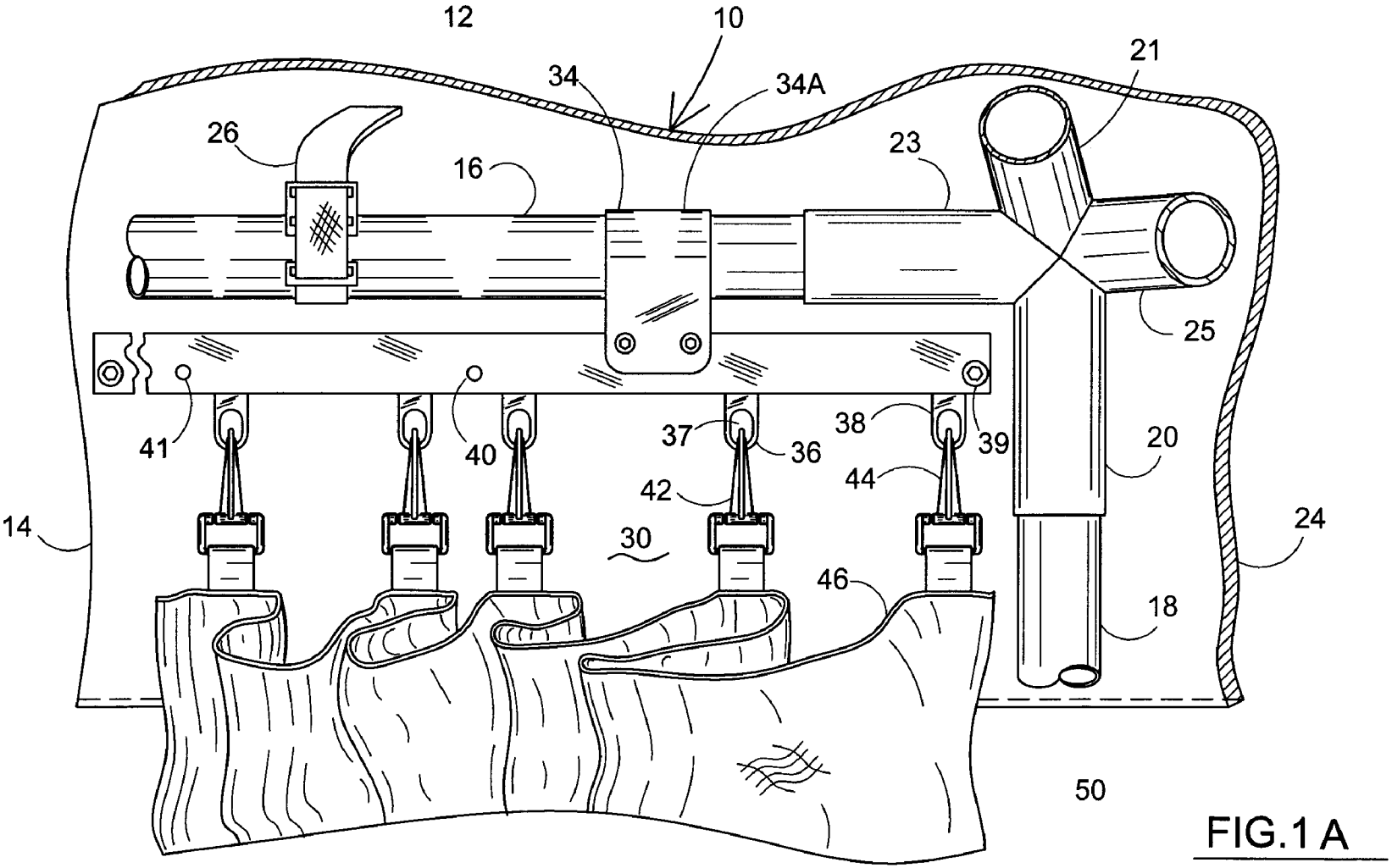
FIG. 1A diagrammatically illustrates a detailed view of the removable track system mounted on the horizontal tent frame member.

FIG. 1A diagrammatically illustrates a detailed view of the removable track system. The tent 10 includes an upper tent roof 12 and short awnings or truncated curtains 14, 24. The short curtains or awnings normally extend 12-24 inches below the horizontal tent frame. The tent frame includes horizontal tent frame member 16 connected to a joint consisting of downward joint element 20, horizontal joint element 23 (coupled to horizontal frame member 16), roof joint element 21 and adjacent horizontal frame member element 25. An attachment mechanism, typically buckle and strap 26, attaches the tent frame system (horizontal frame 16) to the tent fabric or tent cover material.

Typically, tent sidewall 50 has an upper edge 46 and a plurality of clip hooks 42, 44 attached to or near edge 46.

The prior art system utilizes a rope strung horizontally, generally adjacent horizontal frame 16. The clip hooks 42, 44 are clipped onto the rope. Sometimes the rope is attached to vertical pole 18 and, at other times, is attached around joint 20, 21, 23, 25.

The present invention is a removable track and hanger system 30 which includes a track bar 32 removably hung from horizontal frame member 16. A plurality of J-shaped hangers, one of which is hanger 34 is removably attachable to the horizontal frame 16. See FIG. 3. J-shaped hanger 34 is an inverted J-shaped with a hook portion and an extending leg portion. The hook portion 34A has a complementary shape compared with horizontal frame 16 and the downwardly extending leg portion 34B is attached by attachment elements 35 to the track bar 32. The hook portion fits the horizontal frame with an interference fit. The frame 16 may have various shapes (i.e., square) and the hook 34A complements and matches the shape of the frame. Therefore, "J-shape" refers to complementary frame shapes square, oval, rectangular etc. In one embodiment, hanger attachments 35 are rivets however other attachments such as nuts and bolts and screws may be utilized.

The removable track and hanger 30 also includes a plurality of protruding eyelet hangers 36, 38. The eyelet hangers freely move or glide in the track channel. These eyelet hangers have an upper body which extends into an interior channel and track 32 and a downward extender which defines an eyelet hole 37 through which passes the clip hook. See FIG. 2. Therefore, clip hooks 43, 44 are clipped onto eyelet hangers 36, 38 thereby supporting sidewall 50. As stated earlier, the clip hooks 42, 44 are attached to upper edge 46 of tent sidewall 50.

Figure 1B:
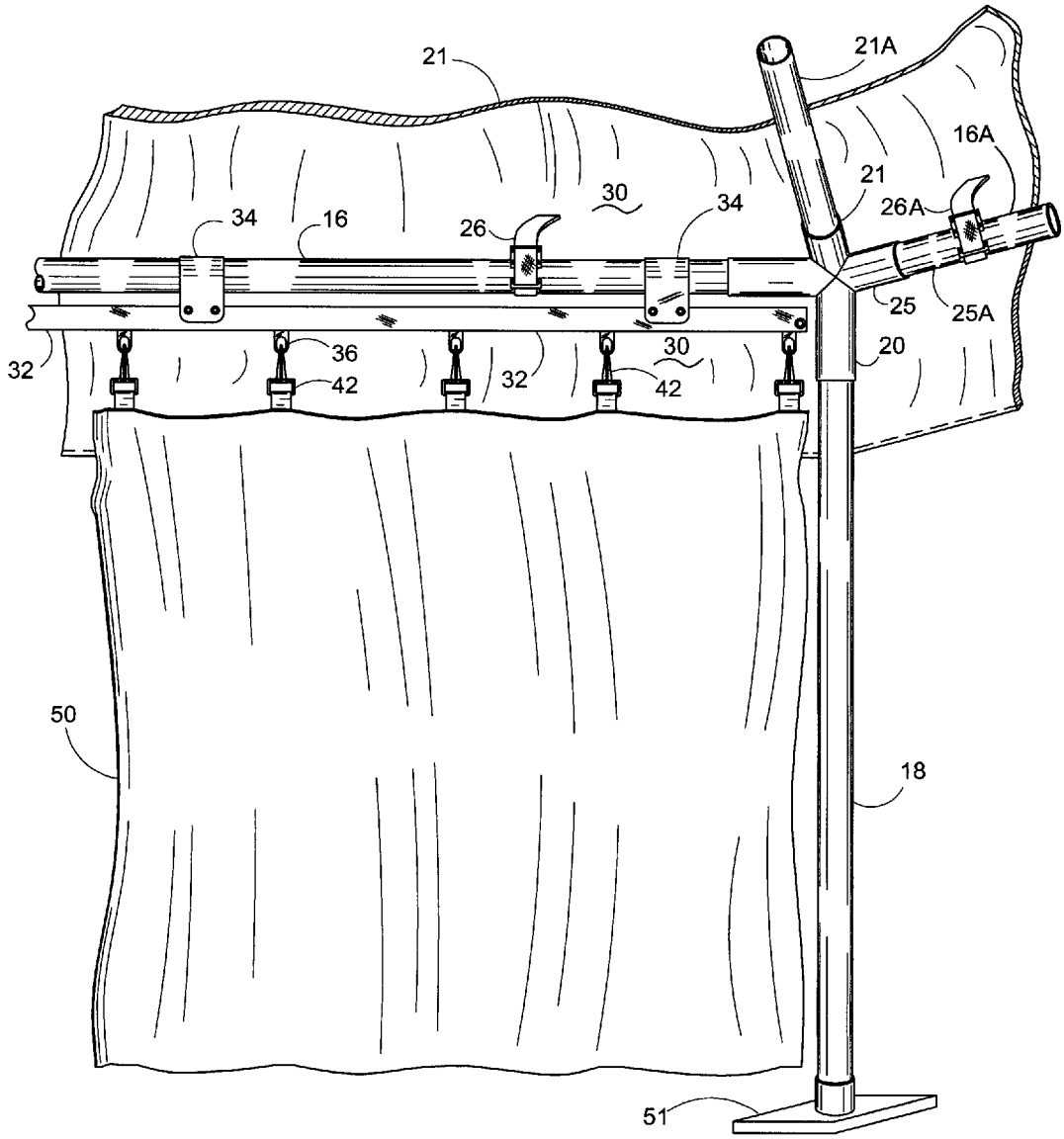
FIG. 1B diagrammatically illustrates the sidewall hung and extending substantially the distance of the vertical tent frame pole thereby providing a movable tent wall.

FIG. 1B diagrammatically illustrates an elevated view of the tent system. A plurality of straps 26, 26A attach the tent roof 12 to the horizontal tent frames 16, 16A. Horizontal tent frame 16A is attached to joint element 25.

Figure 2:
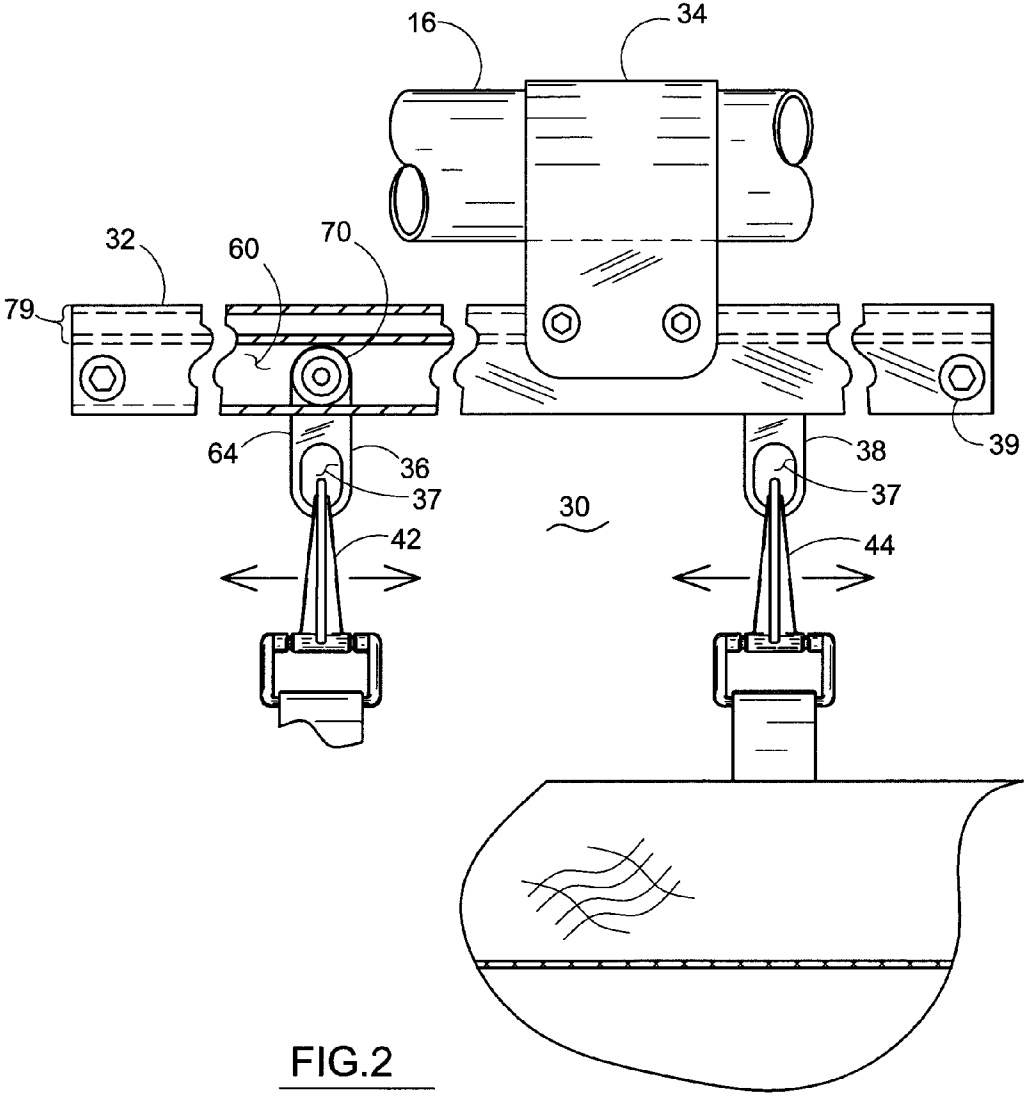
FIG. 2 diagrammatically illustrates the detail of the removable track system, wherein some of the system is shown in cross-sectional view.
Figure 3:
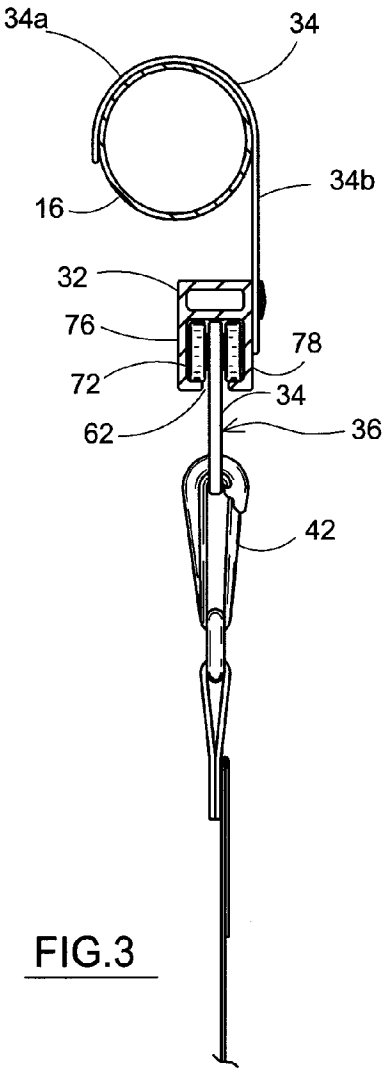
FIG. 3 diagrammatically illustrates an end view of the removable track system.

FIG. 2 diagrammatically illustrates a detailed view of the removable track and hanger. Track bar 32 includes an interior cavity 60 and a mouth 62 (best shown in FIG. 3). Eyelet hanger 36, 38 includes an upper body 64 which protrudes through mouth 62 into interior channel cavity 60. The upper body 64 of each eyelet hanger includes a capture element 70 which, in the illustrated embodiment, is a roller wheel 72 (shown in FIG. 3). FIGS. 2 and 3 are discussed concurrently herein.

Track bar 32 in the illustrated embodiment has internal surfaces which are opposing C-shapes 76, 78. See also FIG. 7. Since channel mouth 62 is smaller in its lateral dimension than the channel cavity 60, the capture element 70 and, more particularly, rollers 72 rest inside each C-shape. A two roller system is shown herein wherein the upper body 64 of eyelet hanger 36 is intermediate the two rollers. The rollers are connected by an axle and the eyelet is connected intermediate the rollers to the axle. In the illustrated embodiment, track bar 32 has an upper portion 79 which attaches to the inverted J-shaped hanger 34.

The channel cavity 60 may take various shapes. With a single roller element 72, a single L-shaped interior surface is an alternative. The roller 72 would roll on the horizontal leg of the L-shape.

FIG. 3 diagrammatically shows that the hook portion 34A of inverted J-shaped hanger 34 is complementary to the upper region of horizontal frame 16. Upper region 79 of track bar 32 is attached to the inverted J-shaped hangers. The J-shaped hangers shown in FIG. 3 include a downwardly extended leg portion 34B which is attached at upper region 79 of track bar 32. Other attachment mechanisms and other locations for attachment may be utilized.

Figure 4:
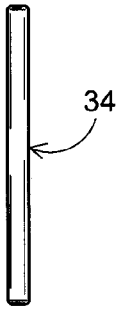
FIGS. 4 and 5 diagrammatically show the eyelet hanger and the upper body of the hanger as well as the eyelet hole.
Figure 5:
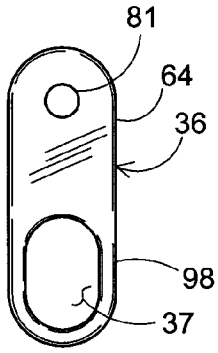

FIGS. 4 and 5 diagrammatically show portions of the eyelet hangers and particularly the upper body 64 of eyelet hanger 36 and the eyelet hole 37.

Figure 6A:
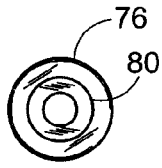
FIGS. 6A and 6B diagrammatically illustrate the roller system for one embodiment of the hanger system.
Figure 6B:
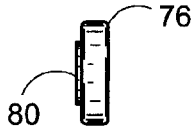

FIGS. 6A and 6B diagrammatically show rollers 76 having a low coefficient of friction rolling body 76 and an inner element 80. The central hole in inner element 80 retains an axle. The axle passes through the pair of rollers and through hole 81 of upper body 64 of eyelet hanger 36. In a working embodiment, the bodies 76, 80 are integral or singular structures. The axial length of inner body segment 80 is smaller than body segment 76 to create a cavity for the end cap of the wheel axle.

Figure 7:
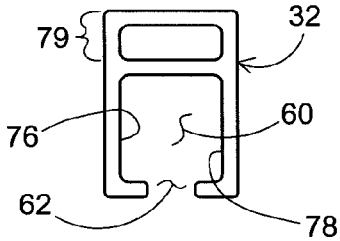
FIG. 7 diagrammatically illustrates a cross-sectional view of the track.

FIG. 7 shows track bar 32, central cavity 60 which is larger than mouth 62, and opposing C-shaped sidewalls 76, 78.

Figure 8A:
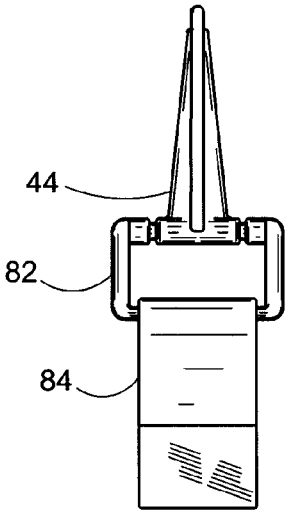
FIGS. 8A and 8B diagrammatically illustrate a front view and a side view of the clip hooks on the tent sidewalls as prior art.
Figure 8B:
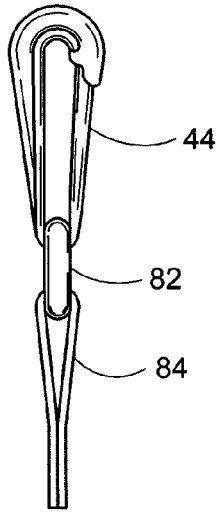

FIGS. 8A and 8B show clip hook 44 with a swivel element 82 and a strap 84. Strap 84 is attached to the top edge 46 of tent sidewall 50.

Figure 9A:
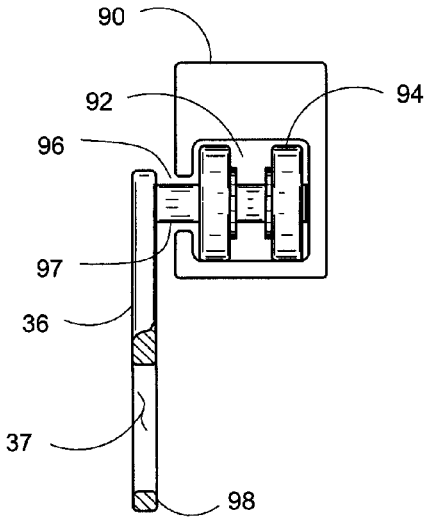
FIGS. 9A and 9B diagrammatically illustrate alternate systems for the track and hanger.

FIG. 9 shows track bar 90 having and defining a cavity 92 with a one or more rollers 94. The cavity has a mouth 96 which is disposed at the side of track bar 90. The mouth is open to a lateral side of the track bar. The eyelet hanger 36 has an upper body element 97 which is normal (perpendicular) to the downward extender 98 of eyelet 36. Eyelet hole 37 is also shown. Two or more rollers 94 can be disposed in interior cavity 92. The downward extender 98 of eyelet hanger 36 is also shown in FIG. 5.

Figure 9B:
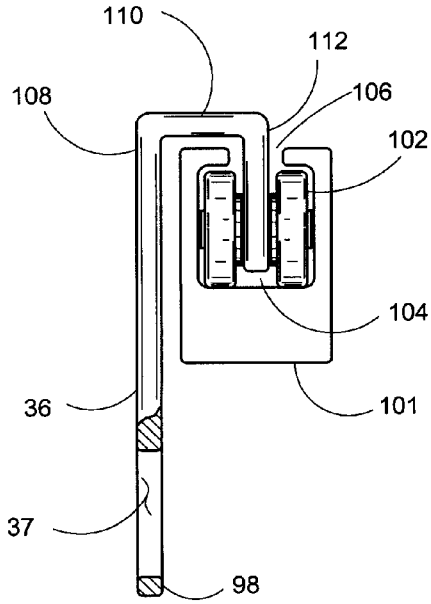

FIG. 9B shows track bar 101 with one or more rollers 102 in interior cavity 104. The track bar mouth 106 is smaller than cavity 104. Eyelet hanger 36 includes an upper body 108 which further includes horizontal element 110 and downward stem 112. Downward stem 112 is attached to the axle of one or more rollers 102.

Figure 10:
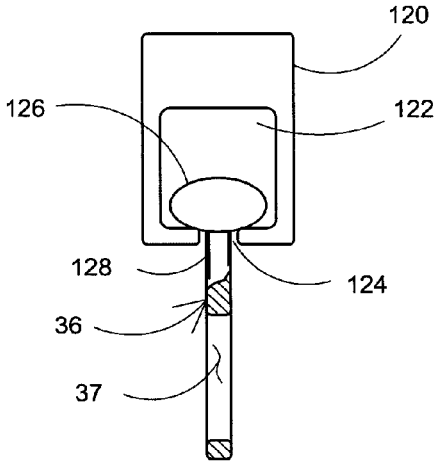
FIG. 10 diagrammatically illustrates a low friction capture element configured, in the illustrated embodiment, as a ball.

FIG. 10 diagrammatically shows hanger bar 120 with cavity 122 forming a mouth 124. A capture element 126 has a low coefficient of friction and slides within channel 122. Eyelet hanger 36 has an eyelet hole 37 and an upper body 128 attached to capture element 126. The capture element may have various shapes formed by material having a low coefficient of friction. A low coefficient of friction between the track channel and the capture element reduces drag when the sidewall is pulled left or right (horizontally).

In operation, the track and hanger system provides a method for mounting movable tent sidewalls onto a horizontal tent frame member. As stated earlier, the horizontal tent frame member is part of a tent frame system with horizontal tent frame members elevated above a ground plane by vertical tent frame pole members. The tent frame system supports a tent canopy as shown in the drawings. The tent sidewall has edge-mounted clip hooks which clip onto eyelet hangers hanging from the track bar member. As shown in FIGS. 1A and 2, the track bar has a number of downwardly protruding eyelet hangers which hangers are movably mounted within said track bar. The eyelet hangers move longitudinally within and along the track bar. End stops 39 block the eyelet hangers from exiting the track bar interior channel. Additionally, stop pins may be inserted into holes 40, 41 (FIG. 1A) in order to limit sidewall movement to the longitudinal region between the stops. The holes define predetermined stop locations.

The track bar is hung from the horizontal frame at a plurality of locations such that the hanging track bar can be removed and reinstalled on a re-constructed tent frame system. The inverted J-shaped hanger fits tightly on the frame 16, but can be readily removed from the frame by an upward force or motion. The J hanger is short (about 4-6 inches) and can be stored with the disassembled horizontal and vertical frame elements. In this manner, the track hanger system can be moved to any desired location on the tent frame assembly, different tent sidewalls can be used with different track hangers, and storage of the tracks and the other tent frame members is easy.

The eyelet hangers either roll within said track bar due to roller wheels 70 or slide or glide in the track channel with the use of a low friction capture element located in the track channel. The tent sidewall clip hooks are clipped onto the downwardly protruding eyelet hangers such that the tent sidewall can be removed and installed on tent frame system at any desired location. One advantage over the prior art rope hanger system is that the track hanger can be mounted at a midpoint on a horizontal frame and only that portion of the horizontal run of the tent will have a movable sidewall. In other words, the track hanger ends limit the movement of the sidewall due to either end stops or due to the insertion of pin stops. The throw or longitudinal movement of the tent sidewall is limited by end stops or intermediately inserted pin stops which stop the eyelet hangers at one or more predetermined stop locations.

The claims appended hereto are meant to cover modifications and changes within the scope and spirit of the present invention.

What is claimed is:

1. A removable track and hanger system removably mounted onto a horizontal tent frame member, said horizontal tent frame member being part of a tent frame system with a plurality of horizontal tent frame members elevated above a ground plane by a plurality of vertical tent frame pole members and said tent frame system adapted to support a tent canopy thereon, said track and hanger system providing hanging support for a movable tent sidewall which sidewall substantially extends the height of the vertical tent frame pole members, said tent sidewall having a plurality of clip hooks attached to a top edge thereof, the removable track and hanger system comprising:

a track bar adapted to be removably hung from one horizontal tent frame member;

a plurality of inverted J-shaped hangers attached to said track bar, each J-shaped hanger having a hook portion and an extending leg portion, said hanger hook portion being complementary to said horizontal tent frame member and said leg hanger portion extending downward and coupling said track bar to said horizontal tent frame member;

said track bar having a track bar channel therein defined by an open mouth and an interior cavity substantially along the track bar which cavity is larger than said channel mouth;

a plurality of protruding eyelet hangers movably mounted in said track bar channel such that the eyelet hangers can be moved to any position along said track bar, each eyelet hanger having an upper body with a capture element located within said track bar interior cavity and each eyelet hanger having a downward extender defining an eyelet hole for a respective clip hook along the top edge of said tent sidewall;

wherein said plurality of tent sidewall clip hooks are adapted to be clipped onto a corresponding plurality of eyelet hangers thereby permitting said tent sidewall to be moved horizontally along said track bar and said one horizontal tent frame member; and a plurality of lateral passages in said track bar and across said track bar channel and at least one stop having a pin complementary to said lateral passage whereby said stop pin can be removably inserted and withdrawn from one of a number of lateral passages thereby limiting the movement of said tent sidewall.

2. A removable track and hanger system as claimed in claim 1 wherein said capture element has a low coefficient of friction thereby permitting said eyelet hangers to move freely in said track bar.

3. A removable track and hanger system as claimed in claim 1 wherein said capture element includes a roller rotatably mounted on said upper eyelet body, said roller adapted to move in said interior cavity along said track bar.

4. A removable track and hanger system as claimed in claim 2 wherein said capture element includes two rollers rotatably mounted on said upper eyelet body and movable in said track cavity.

5. A removable track and hanger system as claimed in claim 1 wherein said track bar mouth is defined as a downwardly open channel and said upper body of said eyelet hangers extends upward into said track interior cavity.

6. A removable track and hanger system as claimed in claim 3 wherein said track bar mouth is defined as a downwardly open channel, at least a portion of said track interior cavity defines a C-shape, said upper body of said eyelet hangers extends upward through said track bar mouth and into said track interior cavity and said roller moves on a lower segment of said C-shaped interior cavity.

7. A removable track and hanger system as claimed in claim 4 wherein said track bar mouth is defined as a downwardly open channel, said track interior cavity defines opposing C-shapes about said mouth, said upper body of said eyelet hangers extends upward through said mouth and into said track interior cavity and said rollers move on respective lower segments of said opposing C-shapes in said interior cavity.

8. A removable track and hanger system as claimed in claim 7 wherein said eyelet hanger upper body is mounted intermediate said two rollers.

9. A removable track and hanger system as claimed in claim 1 including at least one fixed stop in said interior cavity which limits movement of the tent sidewall.

10. A method for mounting movable tent sidewalls onto a horizontal tent frame member, said horizontal tent frame member being part of a tent frame system with a plurality of horizontal tent frame members elevated above a ground plane by a plurality of vertical tent frame pole members and said tent frame system adapted to support a tent canopy thereon, said tent sidewall having a plurality of clip hooks attached to a top edge thereof, the method comprising:

providing a track bar with a plurality of downwardly protruding eyelet hangers movably mounted within said track bar;

hanging said track bar at a plurality of locations along one horizontal tent frame member such that the hanging track bar can be removed and reinstalled onto said tent frame system on any one of said plurality of horizontal tent frame members;

permitting said eyelet hangers to roll within said track bar;

clipping said tent sidewall clip hooks to said downwardly protruding eyelet hangers such that said tent sidewall can be removed and installed onto said tent frame system; and limiting the throw of the tent sidewall by stopping said eyelet hangers at one or more predetermined stop locations, wherein the limitation of tent sidewall movement is due to removable lateral stop pins insertable into said track bar blocking the rolling of said eyelet hangers.

11. A method for mounting movable tent sidewalls onto a horizontal tent frame member, said horizontal tent frame member being part of a tent frame system with a plurality of horizontal tent frame members elevated above a ground plane by a plurality of vertical tent frame pole members and said tent frame system adapted to support a tent canopy thereon, said tent sidewall having a plurality of clip hooks attached to a top edge thereof, the method comprising:

providing a track bar with a plurality of downwardly protruding eyelet hangers movably mounted within said track bar;

hanging said track bar at a plurality of locations along one horizontal tent frame member such that the hanging track bar can be removed and reinstalled onto said tent frame system on any one of said plurality of horizontal tent frame members;

permitting said eyelet hangers to glide under low friction conditions within said track bar;

clipping said tent sidewall clip hooks to said downwardly protruding eyelet hangers such that said tent sidewall can be removed and installed onto said tent frame system; and limiting the throw of the tent sidewall by stopping said eyelet hangers at one or more predetermined stop locations, wherein the limitation of tent sidewall movement is due to removable lateral stop pins insertable into said track bar blocking the glide of said eyelet hangers, thereby permitting adjustable spans of said tent sidewall.

* * * * *